United States Patent [19]

Reynolds

[11] 4,378,095

[45] Mar. 29, 1983

[54] METHODS AND APPARATUS FOR RETAINING TUBULAR OBJECTS

[75] Inventor: Wyndall O. Reynolds, Monrovia, Calif.

[73] Assignee: Bell & Howell Company, Chicago, Ill.

[21] Appl. No.: 210,871

[22] Filed: Nov. 28, 1980

[51] Int. Cl.[3] ..... B65H 19/02

[52] U.S. Cl. ..... 242/68.4

[58] Field of Search ..... 242/68.4, 68, 73, 129.51, 242/129.53, 129.6, 129.62; 346/136; 269/207, 212; 279/1 DC; 82/43

[56] References Cited

U.S. PATENT DOCUMENTS

| | | | |
|---|---|---|---|
| 829,185 | 8/1906 | Votey . | |
| 1,028,506 | 6/1912 | Thieme | 242/129.6 |
| 1,531,705 | 3/1925 | Little . | |
| 1,693,876 | 12/1928 | Unruh . | |
| 1,702,971 | 2/1929 | Jeffress . | |
| 1,724,034 | 8/1929 | Mayer . | |
| 2,185,780 | 1/1940 | Uytenbogaart | 242/129.6 |
| 2,771,251 | 11/1956 | Silverstein . | |
| 3,104,073 | 9/1963 | Post . | |
| 3,216,021 | 11/1965 | Stefansson . | |
| 3,322,359 | 5/1967 | Dales et al. | 242/68 |
| 3,360,210 | 12/1967 | Frisbie | 242/65 |
| 3,368,769 | 2/1968 | Obenshain | 242/68.4 |
| 3,497,152 | 2/1970 | Ivaldi | 242/67.3 R |
| 3,539,126 | 11/1970 | Meserve . | |
| 3,720,385 | 3/1973 | Staats | 242/68.5 X |
| 3,730,452 | 5/1973 | Schwartz | 242/68.4 |
| 3,792,825 | 2/1974 | Kampf | 242/67.3 R |
| 3,941,320 | 3/1976 | Strunk | 242/68.4 X |
| 3,955,770 | 5/1976 | Offermann | 242/68.4 |
| 4,008,861 | 2/1977 | Hertel | 242/68.4 X |

FOREIGN PATENT DOCUMENTS

| | | |
|---|---|---|
| 1899660 | 7/1964 | Fed. Rep. of Germany . |
| 6908020 | 2/1969 | Fed. Rep. of Germany . |
| 1912199 | 10/1969 | Fed. Rep. of Germany . |
| 7107188 | 2/1971 | Fed. Rep. of Germany . |
| 1146525 | 3/1969 | United Kingdom . |
| 1241696 | 8/1971 | United Kingdom . |
| 1300378 | 12/1972 | United Kingdom . |
| 1471361 | 4/1977 | United Kingdom . |

*Primary Examiner*—John M. Jillions

*Attorney, Agent, or Firm*—Benoit Law Corporation

[57] ABSTRACT

Apparatus and methods for releasably retaining any one of several tubular objects of different lengths between first and second retention members provide a rod insertable into any one of said tubular objects and a carriage slidable along that rod. The lengths of the rods are grouped into a plurality of different ranges of lengths. Stepped adjustment of the position of the carriage and second retention member to any of the ranges of lengths is provided for by means of a bayonet joint arrangement having as many distinct first bayonet joint portions as there are ranges of length, and having a second bayonet joint portion common to and interfitting with each of said first bayonet joint portions and being connected to the carriage. The first and second retention members are supported on the rod and on the carriage, respectively. The supporting rod is inserted into any one of the tubular objects and the carriage on the rod is placed in stepped adjustment to the range of lengths into which the particular tubular object is grouped. The second bayonet joint portion is interfitted with the first bayonet joint portion corresponding to the particular range of lengths and the position of one of the retention members is adjusted to the length of the particular tubular object relative to the other retention member to retain that tubular object between the first and second retention members.

36 Claims, 4 Drawing Figures

METHODS AND APPARATUS FOR RETAINING TUBULAR OBJECTS

BACKGROUND OF THE INVENTION

1. Field of the Invention

The subject invention relates to oscillography and oscillographs and other recording methods and recorders, to methods and apparatus for supplying wound material from rolls of diminishing diameter and other winding and reeling methods and apparatus, to methods and apparatus for releasably retaining any one of several tubular objects of different lengths, and to combinations of such methods and apparatus.

2. Disclosure Statement

This disclosure statement is made pursuant to the duty of disclosure imposed by law and formulated in 37 CFR 1.56(a). No representation is hereby made that information thus disclosed in fact constitutes prior-art inasmuch as 37 CFR 1.56(a) relies on a materiality concept which depends on uncertain and inevitably subjective elements of substantial likelihood and reasonableness, and inasmuch as a growing attitude appears to require citation of materials which might lead to a discovery of pertinent material, though being not of themselves pertinent.

The advanced type of recording medium transport mechanism disclosed in U.S. Pat. No. 3,216,021 is typical of prior-art equipment which required the recording material to be disposed on a core with laterally projecting shafts on the supply and takeup sides. U.S. Pat. Nos. 1,531,705, 1,676,797, 3,360,210, 3,497,152, 3,539,126, and 3,720,385 proposed various winding devices and similar apparatus which in one form or another appear to share the latter drawback; impairing a desired versatility of such systems, requiring typically extra rewinding operation of the wound materials, and rendering paper or other material size changes often difficult.

In the prior-art equipment under consideration, there also exists a need for more convenient and effective supply roll mounting systems for accommodating supply rolls located on tubular supports of different lengths. In more general terms, there exists a need for methods and apparatus for releasably retaining any one of several tubular objects of different lengths.

In this respect, an early proposal according to U.S. Pat. No. 1,693,876 employs conical cable drum retaining members which are rotatably mounted on a pair of spaced standards. In practice, there existed the drawback that at least an entire standard had to be moved to accommodate cable drums of different width. To somewhat alleviate this problem, the proposal according to U.S. Pat. No. 3,955,770 mounts the coil-supporting assemblies on tracks for sliding movement toward and away from each other.

U.S. Pat. No. 3,368,769 proposed a tapered core chuck with floating key for roll retention purposes. German Utility Model Registration 7 107 188 proposed a rather bulky handwheel adjustment mechanism.

Similarly, the proposal according to British Patent Specification 1,471,361, by Dow Chemical Company, employs an air cylinder mechanism for mounting and actuating a roll retention plug. In the proposal according to U.S. Pat. No. 2,771,251, a movable chuck is biased by a compression spring which thus acts on the member to be retained. In either case, a delicate roll or tubular member would be exposed to damage. This applies also to U.S. Pat. No. 1,724,034 which employs a single bayonet joint on a spindle in conjunction with a spring-loaded barrel.

On the other hand, U.S. Pat. No. 829,185 proposed use of a bayonet joint in a device for alternatively retaining rolls of two different widths. Since that proposal used the transverse portion of an L-shaped slot for one roli width and the bottom of the longitudinal portion of that slot for the other roll width, that approach was limited in utility to one pair of rolls.

The proposal according to U.S. Pat. No. 1,702,971 employs flat paddles for supporting bolts of cloth preparatory to and during unwinding operations. One of the paddles is rotatably mounted on a standard which, together with a tubular track extending parallel to an axis through the paddles, is attached to the floor. The other paddle is rotatably mounted on a standard which, in turn, is supported on a tubular carriage riding in the mentioned tubular track. A spring has opposite ends attached to, and extends through the tubular track and carriage; biasing the carriage into the tubular track. A locking device arrests the motion of the carriage relative to the tubular track at any one of several incremental portions in order to permit an accommodation of bolts of cloth of different widths.

In so arresting the motion of the carriage, the locking device also renders the mentioned spring ineffective from exercising a biasing function on the cloth retaining paddles.

In practice, the latter drawback coupled with an only step-wise adjustability of the distance between the paddles would render that prior-art system unsuitable for releasably retaining tubular members or supply rolls of different lengths.

An infinitely adjustable spacing between supply roll retention members appear possible in the system disclosed in U.S. Pat. No. 3,104,073. However, the use of a tool and the carrying out of set screw releasing and tightening operations are then required for each change in supply roll width. A subsequent proposal according to U.S. Pat. No. 3,322,359 uses a longitudinal keyway on a support shaft to secure spring-loaded core spacers against rotational movement. A further proposal according to U.S. Pat. No. 3,941,320 appears only suitable for clamping tubular supply roll supports of a given length.

A proposal according to U.S. Pat. No. 3,792,825 uses spring clamps acting on the outside of a supply roll for retaining same in a chart drive system. That principle appears to be rather limited to the handling of perforated paper rolls. The latter patent also proposes the use of pads as braking devices. Again, there appears to be a design limitation to particular chart roll materials.

German Utility Model Registration 1 899 660 proposes use of a compression spring for side loading a retention member against a roll.

A proposal according to British Patent Specification 1,300,378 also uses a compression spring for side loading a retention member against a roll. A common problem with this and other designs using side-loading springs is that they in effect remove control of the roll retention tension from the control of the operator and, as mentioned above, tend to eventuate damage to retained rolls, especially if a firm retention of the roll is desired or required.

The proposal according to British Patent Specification 1,241,696 avoids a side-loading bias spring, but requires an elaborate carriage for mounting and placing a guide cone if rolls of different widths are to be accommodated. British Patent Specification 1,146,525 provides aligned holes in a roll support shaft and in a slidable member on which a cone-shaped roll retention member is threaded. In addition to these aligned holes, that proposal requires a pin insertable into corresponding holes for releasable retention of the slidable member. That pin has to have a handle by means of which it is inserted and removed in matching holes.

In practice, the pin may get lost and with its handle or other projecting part, expose operators to injury. Also, achievement of exact registry of the aligned holes in the slidable member with corresponding holes in the supporting shaft typically is a tedious job in practice.

German Utility Model Registration 69 08 020 proposed use of a first roll retention member attached to a shaft by a set screw and a second roll retention member having a set screw engaging a threaded jacket on the shaft, and proposed the use of several of such threaded jackets for various roll width. This would have complicated an already delicate design.

The copending patent application Ser. No. 925,498, filed July 17, 1978, now U.S. Pat. No. 4,312,006, by Lawrence Vincent Maldarelli, for Methods and Apparatus for Recording Information, Supplying Wound Materials and Retaining Tubular Objects, assigned to the subject assignee and herewith incorporated by reference herein, discloses several methods and apparatus as suggested by its title. For instance, that copending application discloses tubular member and recording medium roll retention systems wherein one of two locked retention members is resiliently biased against a retained tubular object. While that retention system performs excellently, its implementation so far has been rather expensive and the mentioned bias has tended to require a rather sturdy construction due to side loads. There thus exists a need for a less costly and typically lighter system essentially free from side load effects. A subsequent patent application, Ser. No. 06/049,537 filed June 18, 1979, now U.S. Pat. No. 4,284,995 by Gary G. Gordon, for Methods and Apparatus for Recording Information, Supplying Wound Materials and Retaining Tubular Objects, and assigned to the subject assignee addresses itself to the latter need, but for use with rolls of widely varying widths, entails lengthy threading operations.

SUMMARY OF THE INVENTION

It is a general object of this invention to alleviate or avoid the above mentioned disadvantages and to satisfy the above mentioned needs.

It is a germane object of this invention to provide improved methods and apparatus for releasably retaining any one of several tubular objects of different lengths.

It is also an object of this invention to provide improved methods and apparatus for supplying wound material from any one out of several different rolls;

It is a related object of this invention to provide improved methods and apparatus for supplying wound material from or to a roll located on a tubular support.

It is also an object of this invention to provide improved methods and apparatus for recording information.

It is a related object of this invention to provide improved methods of oscillography and oscillograph apparatus.

It is also an object of this invention to provide novel combinations of features leading to improved oscillography and oscillographs or other information recording systems; including combinations of methods or apparatus for supplying wound material from or to a roll located on a tubular support with methods and apparatus for releasably retaining any one of several tubular objects of different lengths.

From one aspect thereof, the subject invention resides in a method releasably retaining any one of several tubular objects of different lengths between first and second retention members. The invention in particular provides a rod insertable into any one of the mentioned tubular objects, and a carriage slidable along the rod. The invention groups said lengths into a plurality of different ranges of lengths and provides for stepped adjustment of the position of the carriage and second retention member to any one of said ranges of lengths by providing a bayonet joint arrangement having as many distinct first bayonet joint portions as there are ranges of length in said plurality, and having a second bayonet joint portion common to and interfitting with each of the first bayonet joint portions. The invention further arranges the first bayonet joint portions in series on the rod, with each first bayonet joint portion being located in correspondence to a different one of said ranges. The second bayonet joint portion is connected to the carriage, and the first and second retention members are supported on the rod and the carriage, respectively.

In order to mount any one of the tubular objects, the rod is inserted into that one tubular object. The carriage is placed on the rod in stepped adjustment to the range of lengths into which that one tubular object is grouped. The second bayonet joint portion is interfitted with the first bayonet joint portion that corresponds to said range of lengths and the position of said second retention member on said carriage is adjusted to the length of the mentioned one tubular object relative to the first retention member to retain that one tubular object between said first and second retention members.

From a related aspect thereof, the subject invention resides in apparatus for releasably retaining any one of several tubular objects having lengths in a plurality of different ranges of lengths, comprising, in combination, a rod insertable into any one of said tubular objects, a carriage slidable along that rod, first and second retention members positioned on the rod and the carriage, respectively, means on the carriage and the rod for stepped adjustment of the position of the carriage and second retention member to any one of said ranges of lengths, including a bayonet joint arrangement having as many distinct first bayonet joint portions arranged in series on the rod as there are ranges of lengths in said plurality, with each first bayonet joint portion corresponding in location to a different one of said ranges, and having a second bayonet joint portion common to and interfitting with each of the first bayonet joint portions connected to the carriage, and means on said carriage for infinite adjustment of the position of that second retention member along said carriage relative to said first retention member to the length of any tubular object within a given range of lengths.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

Figure 1:
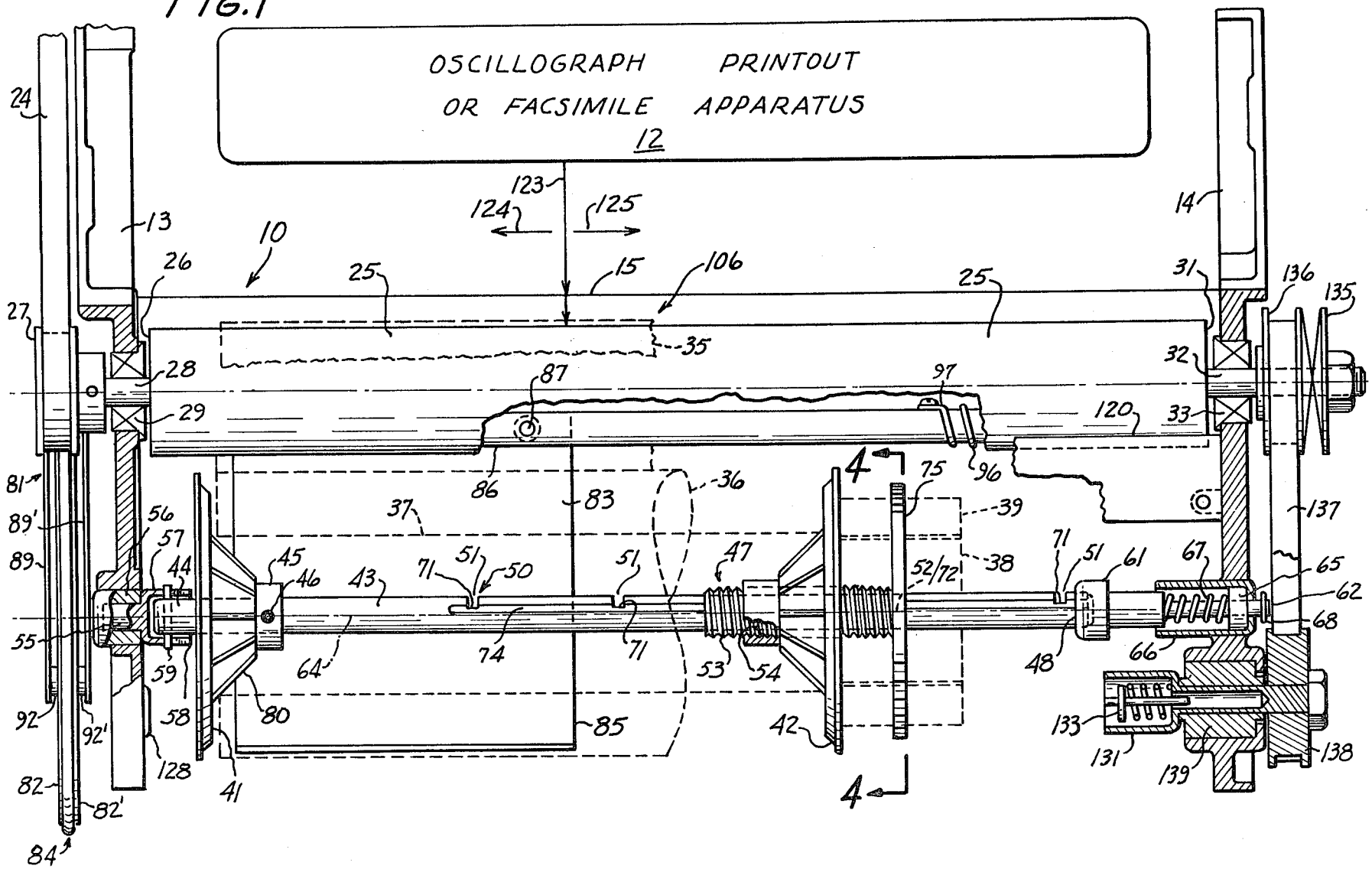
FIG. 1 is a top view, partially in section, of a paper transport for or of an oscillograph apparatus in accordance with a preferred embodiment of the subject invention.

The paper transport according to the illustrated preferred embodiment of the subject invention has utility in all kinds of systems wherein wound paper, recording medium strips or sheets or other material are to be transported from a supply roll. Without limiting the generality of the foregoing, the subject transport has particular utility in advancing and handling recording media and master records in the oscillograph, printout or facsimile apparatus disclosed for example in the assignee's German Patent Specification 28 09 997 published Sept. 21, 1978. Apparatus of the latter type are shown symbolically at 12 in FIG. 1.

Despite the variety of potential and practical uses of various aspect of the subject invention, the illustrated preferred embodiment is herein simply referred to as "paper transport," without any limiting intent.

The paper transport 10 has a frame or support structure including a lateral frame or upright mounting plate 13 and a lateral frame or upright mounting plate 14 interconnected by a rail 15. In addition, the frame structure may include a baseplate, as well as a housing (not shown) which, particularly in the case of electrooptical apparatus, would be of a light-tight type.

The paper transport 10 has an electric motor 17 attached to the mounting plate 13 and consituting a source of rotary drive power for various rotatable parts of the paper transport.

Figure 2:
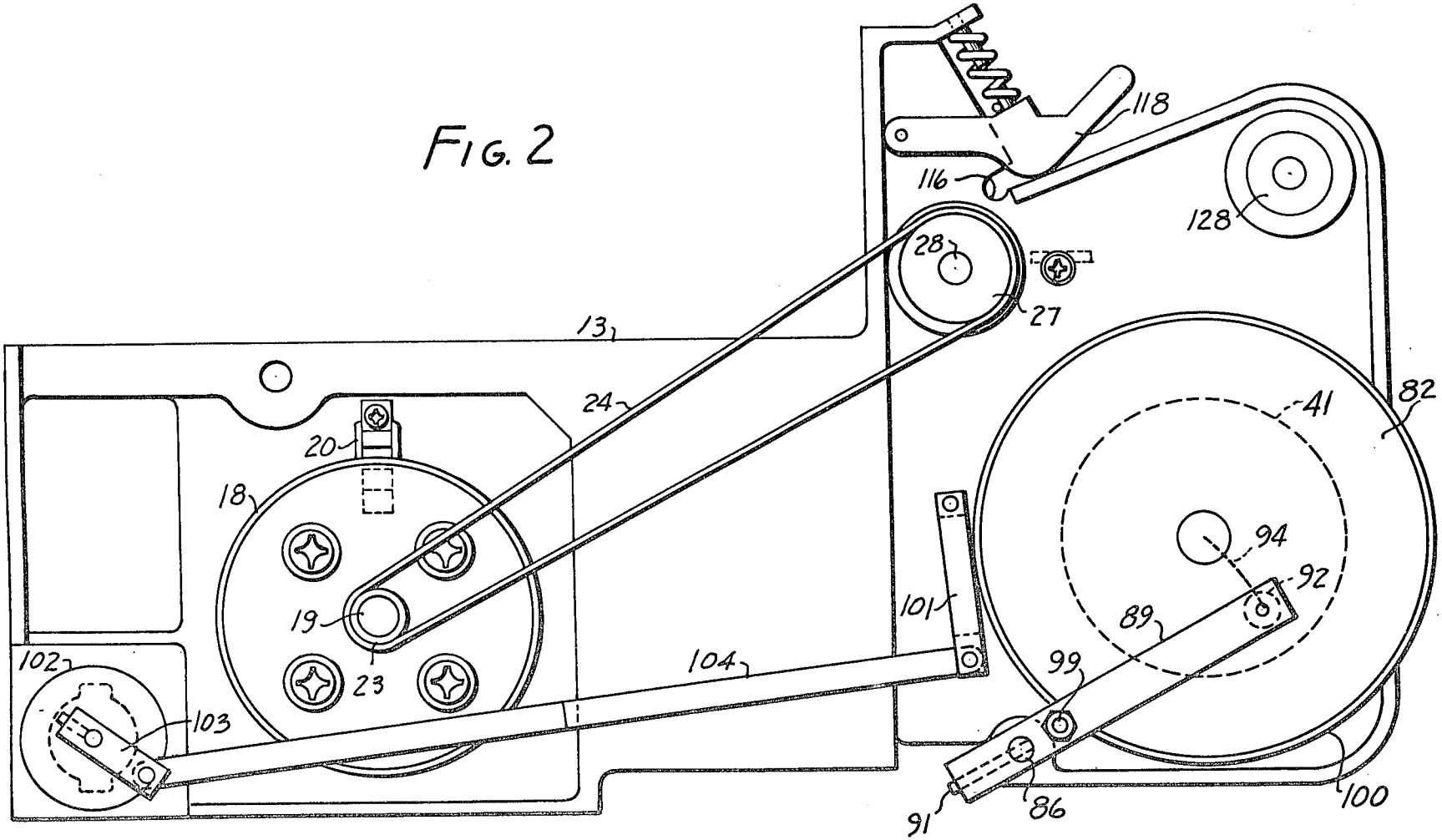
FIG. 2 is a side view of the transport as seen from the left-hand side of FIG. 1.

As shown in FIG. 2, the motor 17 may have a shutter wheel 18 attached to its drive shaft 19 for generating, with the aid of an electrooptical pickup 20, a train of electrical pulses varying directly with paper velocity. These may be used to scale the rate of deposition of information onto the recording medium, such that the information is recorded at the same relative size regardless of paper speed. In addition, since any paper movement results in a finite number of pulses being generated, the output of electrooptical pickup 20 may be counted and this information utilized to stop the transport after a predetermined length of the recording medium has been transported. The motor 17 also has an output pulley 23.

A transmission belt 24 engages the motor output pulley 23 and applies rotary drive power to a drive roller 25 at one end 26 thereof via a drive pulley 27. The drive roller 25 has a shaft 28 extending through a bearing 29 in the side plate 13 to the drive pulley 27 at the one end 26. At the other end 31, the drive roller 25 has a shaft 32 extending through a bearing 33 in the side wall 14 of the transport frame.

An aspect of the subject invention relating to methods and apparatus for releasably retaining any one of several tubular objects of different lengths will now be disclosed with the aid of FIGS. 1,2,3 and 4, in accordance with the illustrated preferred embodiment.

In particular, FIG. 1 shows a supply of wound material, such as an oscillograph paper or other recording medium 35, situated in a roll 36 on a tubular support 37, such as a cardboard tube, indicated in dotted lines.

The paper transport according to the illustrated preferred embodiment of the subject invention is capable of handling oscillograph papers and other recording media of different widths. Accordingly, the tubular supports of various supply rolls usable in the illustrated equipment may be of different lengths.

By way of example, FIG. 1 partially shows by a dotted outline 38 a longer tubular support for a oscillograph paper supply roll 39 of more width than the supply roll 36. The tubular support 38 may also have a diameter different from the diameter of the tubular support 37.

In practice, all these different oscillograph paper widths and tubular support lengths have to be accommodated in the illustrated apparatus. To this end, the transport 10 has a pair of mutually adjustable retention members 41 and 42 and a supporting rod 43 insertable into any one of the tubular objects 37, 38, etc.

The retention member 41 is mounted on the supporting rod 43. In the illustrated preferred embodiment the retention member 41 is attached to the supporting rod 43 near one end 44 thereof, such as with the aid of a collar 45 having a pin 46 extending therethrough and through the rod 43. The other retention member 42 is also supported by the rod 43, as more fully described below. The members 41 and 42 constitute a pair of mutually adjustable retention members on the supporting rod 43 for releasably retaining any one of the tubular objects indicated at 37 and 38 therebetween.

A carriage 47 is slidable along the rod 43; being axially movable thereon and removable from, and insertable onto, an end 48 thereof. The carriage 47 may comprise a tube slidable onto, and axially movable on, the rod 43.

The subject invention groups the various lengths of the tubular members to be retained into a plurality of different ranges of lengths. For example and with reference to FIG. 1, if the various tubular members to be retained between the members 41 and 42 range in length from the size shown in dotted outline at 38 down to about one quarter of that size, and include within these extreme diversions, say, from five to ten different lengths, then such lengths may be grouped into, say, five different ranges of lengths.

The invention according to its illustrated embodiment then provides for stepped adjustment of the position of the carriage 47 and second retention member 42 to any of the ranges of lengths. To this end, the illustrated embodiment provides a bayonet joint arrangement 50 having as many distinct first bayonet joint portions 51 as there are ranges of lengths in the above mentioned plurality of ranges, and having also a second bayonet joint portion 52, seen in FIG. 4, common to and interfitting with each of the first bayonet joint portions 51.

Figure 4:
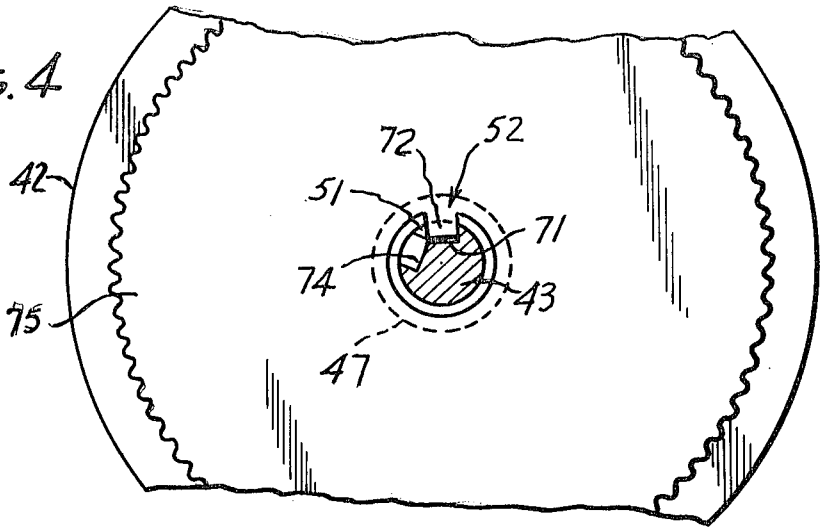
FIG. 4 is a view and section taken on the line 4—4 in FIG. 1, on an enlarged scale.
Figure 3:
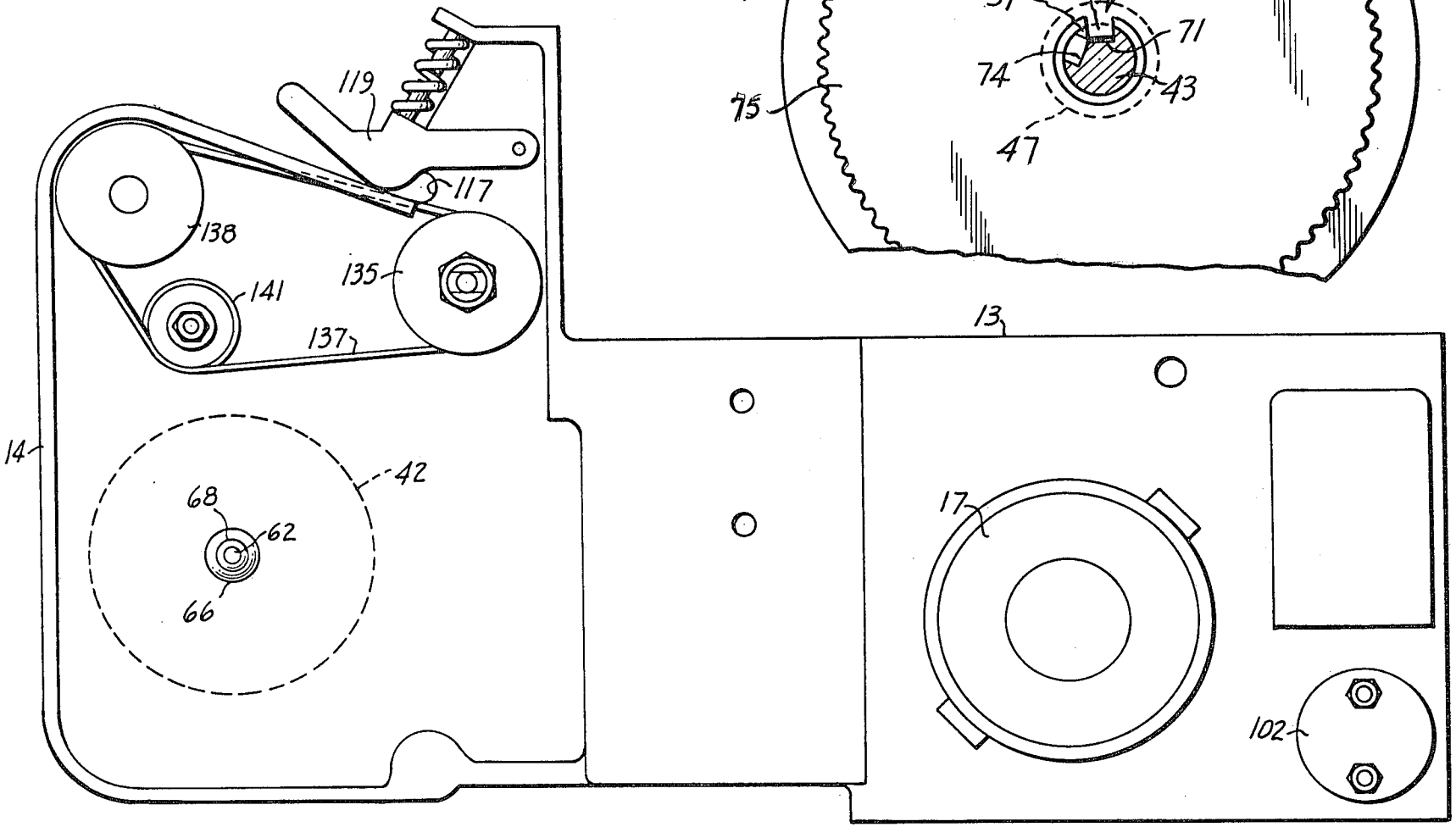
FIG. 3 is a further side view of the transport as seen from the right-hand side of FIG. 1.

In reality, there are in the illustrated example two more first bayonet joint portions 51 between the portions visible in FIG. 1. In particular, there is a further first bayonet joint portion 51 that is seen in FIG. 4, but is covered up in the showing of FIG. 1. There also is an additional first bayonet joint portion covered up by the carriage 47 in FIG. 1.

In practice, these first bayonet joint portions may be identical to each other in configuration.

The illustrated embodiment in particular arranges the first bayonet joint portions 51 in series on the rod 43, with each first bayonet 51 being located in correspondence to a different one of the ranges of lengths the tubular objects to be retained.

The second bayonet joint portion 52, as seen in FIG. 4, is connected to the carriage 47. The first and second retention members 41 and 42 are supported on the rod 43 and on the carriage 47, respectively.

The supporting rod 43 may be inserted into any one of the tubular objects 37, 38, etc., whereupon the carriage 47 is placed on the rod 43 in stepped adjustment to the range of length into which the particular tubular object, such as 37, or 38, is grouped. For instance, the carriage 47 may be placed onto and moved axially along the rod to the position shown in FIG. 1.

The second bayonet joint portion 52 is then interfitted with the first bayonet joint portion 51 as seen in FIG. 4, with that first bayonet joint portion corresponding to the particular range of lengths, such as the range of lengths within which the tubular member 37 falls.

The position of the one retention member, such as the member 42, is then adjusted to the length of the one tubular object, such as the object 37, relative to the other retention member, such as the member 41, to retain the particular tubular object between the first and second retention members, as seen in FIG. 1.

In practice, either one or both of the retention members 41 and 42 may be adjusted in position, but the illustrated embodiment adjusts the member 42 relative to the member 41, which is fixed on the shaft 43.

For example, the second retention member 42 is adjusted in position along the carriage 47 to the length of the particular tubular object. According to the illustrated preferred embodiment of the invention, the carriage 47 is provided with an external thread or externally threaded portion 53 encompassing the rod 43 in slidable relationship.

The retention member 42 is provided with an internal thread or internally threaded portion 54 meshing with the externally threaded portion 53 on the carriage 47. The carriage 47 with associated parts thus constitutes means connected to the retention member 42 for axial movement of the retention member 42 on the supporting rod 43 and for infinite adjustment of the retention member 42 relative to a portion of the supporting rod or to the first retention member 41 as well.

The rod 43 may be mounted for rotation about an axis 64, and the rod 43, with carriage 47, first and second retention members 41 and 42 and retained tubular objects is rotated about that axis. To this end and by way of example, a spindle 55 is rotatable in a bushing 56 in the side plate 13 and has a socket 57 for receiving the end portion 44 of the supporting rod 43. The socket 57 has a pair of diametrically opposite axial slots 58 for receiving lateral projections 59 of the supporting rod 43.

Slots 58 and corresponding projections 59 may be omitted if it is merely desired to mount the supporting rod 43, rotatably, without coupling to any other member.

The other end 47 of the supporting rod is insertable into a cup 61 mounted on or integral with a shaft 62. That shaft 62, as well as the previously mentioned spindle 54, is in line with the longitudinal axis 64 of the supporting rod. In particular, the shaft 62 is rotatably mounted in, and extends through, a bearing 65 which, in turn, is mounted in a bearing holder 66 in the apparatus side wall 14. A spring 67 axially biases the cup 61 in the direction of the spindle 55 or socket 56 against the restraint of a stop 68 on the shaft 62.

Preparatory to the mounting of a tubular object or support 37 or 38, the supporting rod 43 with retention members 41 and 42 is moved axially to the right as seen in FIG. 1, and is removed from the socket 56 and cup 61. The carriage 47 is then unlocked and removed from the supporting rod 43 and the rod 43 is inserted into either tubular object or support 37 or 38 until an end of such object or support abuts the retention member 41 located on rod 43. Alternatively, the rod 43 may be slid axially onto either tubular object or support 37 or 38 until the retention member 41 abuts an end of such tubular object or support.

The previously removed carriage 47 is then played back onto the supporting rod 43 from the end portion 48 thereof. In general, the carriage 47 with retention member 42 is moved along the supporting rod 43 to the position of the appropriate bayonet joint portion 51, where the carriage is locked on the rod by interfitting of joint portions 51 and 52, and the retention member 42 is rotated and moved along the carriage 47, in order to place the retention members 41 and 42 against opposite ends of the tubular object 37 or 38.

In this manner, and by locking on different ones of the first bayonet joint portions 51, tubular objects, or tubular supports of recording medium rolls, of various diameters and widths or lengths may readily be accommodated between the retention members 41 and 42 on the supporting rod.

Once the retention members 41 and 42 have thus been placed into abutment with opposite ends of the particular tubular object or support 37 or 38, the thus placed retention members 41 and 42 are locked against movement away from each other. In the presently best mode contemplated, this locking is effected by making the pitch of the thread 53 such as to provide for a self-locking action between the carriage 47 and retention member 42, when the latter is tightened against the placed tubular object or support 37 or 38 by rotation thereof.

In practice, the thread 53 on the carriage 47 and the meshing thread 54 on the second retetion member 42 constitute an example of a means effective between the retention members 41 and 42 for selectively locking these retention members against movement away from each other. The subject invention thus not only permits an infinitesimal or stepless adjustment in the spacing between the retention members 41 and 42 for an accommodation to various tubular object or supply roll support sizes, but provides also a secure locking action for supply roll clamping purposes.

The assembly comprising the retention members 41 and 42, supporting rod 43, tubular support 37 (or 38) and supply roll 36 is mounted on the apparatus 10 by inserting the rod end 48 into the cup 61 and moving the assembly to the right as seen in FIG. 1, thereby moving the cup 61 against the bias of the spring 67 until the rod end 44 clears the socket 57. The rod end 44 is then inserted into the socket 57 while the bias of the spring 67 is permitted to move the cup 61 and rod 43 to the left as seen in FIG. 1. The rod 43 with retention members 41 and 42, tubular support 37 (or 38) and supply roll 36 assembled thereon, is thus mounted for rotation about rod axis 64.

While this aspect of the subject invention has been disclosed herein primarily in terms of releasable supply roll retention, it should be understood that the principles of this aspect are also applicable in general to the task of retaining any one of several tubular objects of different lengths between a pair of mutually adjustable retention members.

The spring 67 resiliently biases the supporting rod 43 in an axial direction. The mounted supporting rod is rotated about its axis 64, such as by removal of the recording medium or paper 35 from the roll 36, while the placed retention members 41 and 42 are locked against movement away from each other as explained above. In the illustrated preferred embodiment, the biasing function of the spring 67 includes the step of resiliently biasing the mounted supporting rod 43 in an axial direction while the supporting rod is rotated about its axis 64. This retains the rotating rod 43 securely between the socket 57 and cup 61.

Wound material 35 may be supplied from any one of several rolls of wound material located on different tubular supports 37 or 38 of different lengths, with the aid of the mentioned pair of mutually adjustable retention members 41 and 42. In that case, the spring bias just described may again be provided and employed, if desired.

According to the illustrated preferred embodiment of the invention, a specific bayonet joint arrangement may be provided. In particular, the illustrated embodiment provides for stepped adjustment of the position of the carriage on the rod 43 and second retention member 42 to any of the above mentioned ranges of lengths by providing in series on the rod 43 as many distinct transverse slots 71 as there are ranges of lengths in the particular plurality of ranges, with each transverse slot 71 being located in correspondence to a different one of these ranges, and by providing a locking member 72 seen in FIG. 4, common to and interfitting with each of the transverse slots 51. The illustrated embodiment connects the locking member 72 to the carriage 47, such as in the manner seen in FIG. 4.

After the carriage 47 has been placed on the rod 43 in stepped adjustment to the range of lengths into which the particular tubular object 37, 38, etc., is grouped, the locking member 72 is interfitted with the transverse slot 71 corresponding to the particular range of lengths, whereupon the position of the retention member 42 may be adjusted on the carriage 47 exactly to the length of the particular tubular object for a retention thereof between the first and second retention member 41 and 42 on the rod 43.

In the illustrated preferred embodiment, the rod 43 is provided with a longitudinal groove 74 interconnecting the first bayonet joint portions 51 or communicating with the transverse slots 71 for passage of the second bayonet joint portion 52 among the first bayonet joint portions or of the locking member 72 among the transverse slots 71.

Preferably, the second bayonet joint portion 52 or locking member 72 is fixedly attached to the carriage 47. The carriage may be provided with a handle 75 separate from from the second retention member 42 and extending radially to the rod 43. This separate handle preferably is attached to or integral with the carriage, and the rod 43 preferably is encompassed with that handle 75, or the handle encompasses the rod. The locking member 72 may be integral with the handle or disc; forming a projection thereof.

In this manner, the operator may conveniently grab the handle or knurled disc 75, pushing therewith the carriage 47 with screwed-on retention member 42 along the rod 43, with the locking member 72 (FIG. 4) riding in the groove 74. Upon arrival of the locking member 72 at the appropriate transverse slot 71, the manually engaged handle or disc 75 is twisted by an eighth of a turn or so until the locking member has entered the particular slot and locks against the bottom of that slot or the land of the rod 43. The carriage 47 may thus conveniently be locked on and unlocked from the rod 43.

In the illustrated preferred embodiment, a brake is provided such as shown at 81, 92, and 92', and the supporting rod 43 is releasably coupled at its one end 44 to the brake, as seen at 55 and 57 in FIG. 1. The spring 67 then resiliently biases the rotating supporting rod in an axial direction toward the mentioned brake. This in practice applies only a relatively small side loading force to the bearing 56 and to the brake, since clamping of the tubular support 37 (or 38) relies on the described locking action of the retention members, rather than on the strength of any spring bias.

The brake just mentioned may be employed in the context of a supply of wound material from a roll of diminishing diameter at bidirectionally controlled tension. In particular, the supply roll 36 diminishes in diameter as the paper or other sheet-like material 35 is unwound therefrom. It is the task of a mechanical servo system 81 to control the tension of the paper 35 bidirectionally; that is irrespective of the sense of rotation of the supply roll 36 as the paper 35 is unwound or pulled off therefrom.

To this end, the mechanical servo system 81 includes a pair of flat friction surfaces 82 and 83. One of these friction surfaces, namely the surface 82 is circular, being provided on a circular disk 84. The other of the pair of friction surfaces, namely the surface 83, is flat, being provided on a sheet of metal or flapper 85. The flapper 85 is attached to a shaft 86 by fasteners, one of which is seen at 87 in FIG. 1. In this manner, the flapper 85 is able to monitor the radius of the paper supply roll 36 for essentially constant paper tension.

The shaft is journaled for angular movement about its longitudinal axis in the lateral mounting plates 13 and 14 of the frame structure.

An arm structure 89 is attached to a projecting end of the shaft 86 by a pin 91. At its outer extremity remote from the shaft 86, the arm structure 89 carries a friction pad 92 for generating friction on the surface 82.

The friction surface 82 or disk 84 is rotated about an axis 64 perpendicularly intersecting the surface 82 at a distance from the friction generating pad 92 and being the common axis of rotation of the rod 43 and retention members 41 and 42.

The disk 84 is mounted on the shaft of the spindle 54 so that the disk 84 with the friction surface 82 is coupled to the mounted rod 43 and retention members 41 and 42 for rotation therewith and with the supply roll 36 as the paper 35 is unwound therefrom.

The arm structure 89, being attached to the rotatable shaft 86, serves as a means for moving the friction generating pad 92 toward the intersection of the axis 64 with the friction surface 82 along a trajectory or arc of a circle 94 intersecting the axis 64. In practice, this enables an operation of the mechanical servo system 81 in either sense of rotation of the supply roll 36 and disk or friction surface 82 while also enabling the development of a force tending to move the friction generating pad 92 toward the intersection of the axis 64 with the friction surface 82.

Referring to FIG. 2, if the supply roll is wound such that paper leaving the roll causes the surfaces 82 to rotate clockwise there will be generated a force component due to the action of pad 92 (or pads 92 and 92') against surface 82 (or surface 82 and 82') such that arm 89 and shaft 86 are also rotated clockwise. This force is overcome by helical spring 96 having one end attached to the lateral mounting plate 14 and the other end to shaft 86 at 97 and causing arm 89 and shaft 86 to rotate counterclockwise as viewed in FIG. 2. Should the supply roll be wound in the opposite direction, the surfaces 82 will rotate counterclockwise and a force will be generated tending to rotate arm 89 and shaft 86 counterclockwise. This force will add to the torsional moment generated by spring 96. Regardless of the direction of rotation of surfaces 82 there will be generated sufficient torsional moment applied to shaft 86 to keep monitor surfaces 83 in contact with supply roll 36 at all times as paper unwinds and diminishes the supply roll size.

In this manner, there is generated a torque in disk 84 that is directly proportional to supply roll diameter resulting in constant supply tension in the material being removed from the roll. The rubbing contact of monitor surface 83 with supply roll 36 adds to the supply web tension but, in practice, this force is small compared to total web tension and is relatively constant.

In operation, the flatness and relatively large area of the monitor surface 83 and flapper 85 effectively avoid the disadvantages of prior-art roll diameter rollers, including warping and bulging of the wound material on the roll.

Concurrently, the arm structure 89 and its mounting, as well as the location of the friction pads 92 and its movement along the trajectory 94, avoid the prior-art drawback of restriction to operate in only one sense of rotation for the sake of generating the required torsional forces on the monitor shaft.

As seen in FIG. 1, both sides of the circular disk 84 may be utilized as friction surfaces 82 and 82'. The arm structure 89 may then be provided with a pair of arms, one of these carrying the pad 92 in frictional contact with the surface 82 and the other, shown at 89', carrying a friction pad 92' in frictional engagement with the friction surface 82'. An adjustable tensioning device 99, seen in FIG. 2, may be employed for tensioning the arm sections toward each other and the friction pads 92 and 92' into a desired engagement with the circular friction surfaces 82 and 82' on the disk 84.

As seen in FIG. 2, the friction servo disk 84 has a tire 100 which is selectively engaged by a brake 101 whenever power to the drive motor 17 is removed. A rotary solenoid 102 acts on the brake 102 via links 103 and 104. In particular, the solenoid 102 is energized briefly to engage the brake 101 with the tire 100 each time power to the motor 17 is removed. Power is supplied to the solenoid 102 only long enough to cause brake 101 to be applied to the tire 100 to stop the rotation of the supply roll 36 rapidly.

The driver roller 25 is rotatably mounted at a recording station 106 including the oscillograph, printout or facsimile apparatus 12 shown by a block in FIG. 1.

In practice, the recording medium strip 35 is run from the supply roll 36 about part of the drive roller 25 with the information recording surface layer facing away from the drive roller 25 at the recording station 106 irrespective of the direction in which the recording surface layer faces on the supply roll.

The lateral mounting plates 13 and 14 are provided with notches 116 and 117 near the drive roller 25 for receiving the shaft or shaft ends of an idler roller (not shown) which presses the recording medium strip 35 against the drive roller 25.

Manually actuable spring bias grips 118 are provided adjacent the notches 116 and 117 for releasably retaining the idler roller via a shaft or shaft ends not shown at the drive roller.

The idler roller causes sufficient frictional force to be developed between drive roller 25 and recording medium 35 so that it is withdrawn from the supply roll 36 and discharged from the recording station 106 as the information recording operation proceeds.

The recording medium strip is thus driven through the recording station and information is recorded on successive portions of the recording medium strip while each of these portions is located on the drive roller 25 with its information recording surface layer facing away from the drive roller. An arrow 123 in FIG. 1 indicates the luminous output in the case of an oscillograph apparatus, or the luminous sensing beam in the case of facsimile equipment, or then another stimulus in the case of a printout peripheral. Arrows 124 and 125 in FIG. 1 indicate that the beam 123 typically is deflected laterally during operation of the equipment.

If desired, the recording medium strip 35, after having run past the recording station and the drive roller 25, may be wound in a roll on a takeup roller (not shown).

To this end, and as shown in FIGS. 1 and 2, the paper transport is provided with a bearing socket 128 for receiving a shaft end of the takeup roller. The other shaft end of the takeup roller (not shown) is received in a corresponding socket 131 that has a spring 132 cooperating with a driving member 133 for releasably retaining the takeup roller in the paper transport.

While rotary drive power is applied to one end of the drive roller 25 at its shaft 28, rotary drive power is derived from the drive roller 25 at its other end via a slip clutch 135 coupled to the shaft 32, a pulley 36 connected to the slip clutch 135, a transmission belt 137 running from the pulley 136 to a pulley 138 connected to the takeup roller shaft receiving socket 131 via a bearing 139 located in the lateral mounting plate 14. In this manner, drive power for the takeup roller is derived from the other end of the drive roller 25 and is applied to the takeup roller 127 via the rotary socket 131.

Various modifications and variations within the spirit and scope of the subject invention will become apparent or suggest themselves to those skilled in the art.

I claim:

1. A method of releasably retaining any one of several tubular objects of different lengths between first and second retention members, comprising in combination the steps of:

providing a rod insertable into any one of said tubular objects;

providing a carriage slidable along said rod;

grouping said lengths into a plurality of different ranges of lengths;

providing for stepped adjustment of the position of said carriage and second retention member to any of said ranges of lengths by providing a bayonet joint arrangement having as many distinct first bayonet joint portions as there are ranges of lengths in said plurality, and having a second bayonet joint portion common to and interfitting with each of said first bayonet joint portions;

arranging said first bayonet joint portions in series on said rod, with each first bayonet joint portion being located in correspondence to a different one of said ranges;

connecting said second bayonet joint portion to said carriage;

supporting said first and second retention members on said rod and said carriage, respectively;

inserting said rod into any one of said tubular objects;

placing said carriage on said rod in stepped adjustment to the range of lengths into which said one tubular object is grouped;

interfitting said second bayonet joint portion with the first bayonet joint portion corresponding to said range of lengths;

adjusting the position of said second retention member on said carriage to the length of said one tubular object relative to said first retention member to retain said one tubular object between said first and second retention members.

2. A method as claimed in claim 1, including the step of:

providing said rod with a longitudinal groove interconnecting said first bayonet joint portions.

3. A method as claimed in claim 1 or 2, wherein:

said second bayonet joint portion is fixedly attached to said carriage.

4. A method as claimed in claim 1, including the step of:

providing said carriage with a handle separate from said second retention member and extending radially to said rod.

5. A method as claimed in claim 4, wherein:

said separate handle is fixedly attached to said carriage.

6. A method as claimed in claim 4 or 5, including the step of:

encompassing said rod with said handle.

7. A method as claimed in claim 6, wherein:

said second bayonet joint is fixedly attached to said carriage.

8. A method as claimed in claim 1, including the steps of:

providing said carriage with an externally threaded portion encompassing said rod; and providing said second retention member with an internal thread meshing with said externally threaded portion.

9. A method as claimed in claim 1, 2, 4, 5 or 8, including the steps of:

mounting said rod for rotation about an axis; and rotating said rod with carriage, first and second retention members and retained tubular object about said axis.

10. A method of releasably retaining any one of several tubular objects of different lengths between first and second retention members, comprising in combination the steps of:

providing a rod insertable into any one of said tubular objects;

providing a carriage slidable along said rod;

grouping said lengths into a plurality of different ranges of lengths;

providing for stepped adjustment of the position of said carriage and second retention member to any of said ranges of lengths by providing in series on said rod as many distinct transverse slots as there are ranges of lengths in said plurality, with each transverse slot being located in correspondence to a different one of said ranges, and providing a locking member common to and interfitting with each of said transverse slots;

connecting said locking member to said carriage;

supporting said first and second retention members on said rod and said carriage, respectively;

inserting said rod into any one of said tubular objects;

placing said carriage on said rod in stepped adjustment to the range of lengths into which said one tubular object is grouped;

interfitting said locking member with the transverse slot corresponding to said range of lengths; and adjusting the position of said second retention member along said carriage to the length of said one tubular object relative to said first retention member to retain said one tubular object between said first and second retention members.

11. A method as claimed in claim 10, including the step of:

providing said rod with a longitudinal groove communicating with said transverse slots for passage of said locking member among said slots.

12. A method as claimed in claim 10 or 11, wherein:

said locking member is fixedly attached to said carriage.

13. A method as claimed in claim 10, including the step of:

providing said carriage with a handle separate from said second retention member and extending radially relative to said rod.

14. A method as claimed in claim 13, wherein:

said separate handle is fixedly attached to said carriage.

15. A method as claimed in claim 13 or 14, including the step of:

encompassing said rod with said handle.

16. A method as claimed in claim 15, wherein:

said locking member is fixedly attached to said handle.

17. A method as claimed in claim 10, including the steps of:

providing said carriage with an externally threaded portion encompassing said rod; and providing said second retention member with an internal thread meshing with said externally threaded portion.

18. A method as claimed in claim 10, 11, 13, or 14, including the steps of:

mounting said rod for rotation about an axis; and rotating said rod with carriage, first and second retention members and retained tubular object about said axis.

19. Apparatus for releasably retaining any one of several tubular objects having lengths in a plurality of different ranges of lengths, comprising in combination:

a rod insertable into any one of said tubular objects;

a carriage slidable along said rod;

first and second retention members positioned on said rod and said carriage, respectively;

means on said carriage and said rod for stepped adjustment of the position of said carriage and second retention member to any of said ranges of lengths, including a bayonet joint arrangement having as many distinct first bayonet joint portions arranged in series on said rod as there are ranges of lengths in said plurality, with each first bayonet joint portion corresponding in location to a different one of said ranges, and having a second bayonet joint portion common to and interfitting with each of said first bayonet joint portions connected to said carriage; and means on said carriage for infinite adjustment of the position of said second retention member along said carriage relative to said first retention member to the length of any tubular object within a given range of lengths.

20. Apparatus as claimed in claim 19, wherein:

said rod has a longitudinal groove interconnecting said first bayonet joint portions.

21. Apparatus as claimed in claim 19 or 20, wherein:

said second bayonet joint portion is fixedly attached to said carriage.

22. Apparatus as claimed in claim 19, including a handle separate from said second retention member, said handle being connected to said carriage and extending radially to said rod.

23. Apparatus as claimed in claim 22, wherein:

said separate handle is fixedly attached to said carriage.

24. Apparatus as claimed in claim 22 or 23, wherein:

said handle encompasses said rod.

25. Apparatus as claimed in claim 24, wherein:

said second bayonet joint is fixedly attached to said carriage.

26. Apparatus as claimed in claim 19, wherein:

said infinite adjustment means include an externally threaded portion on said carriage emcompassing said rod and an internal thread at said second retention member meshing with said externally threaded portion.

27. Apparatus as claimed in claim 19, 20, 22, 23 or 26, including:

means for mounting said rod for rotation about an axis; and means for rotating said rod with carriage, first and second retention members and retained tubular object about said axis.

28. Apparatus for releasably retaining any one of several tubular objects having lengths in a plurality of different ranges of lengths, comprising in combination:

a rod insertable into any one of said tubular objects;

a carriage slidable along said rod;

first and second retention members positioned on said rod and said carriage, respectively;

means on said carriage and said rod for stepped adjustment of the position of said carriage and second retention member to any of said ranges of lengths, including as many distinct transverse slots arranged in series on said rod as there are ranges of lengths in said plurality, with each slot corresponding in location to a different one of said ranges, and having a locking member common to and interfitting with each of said slots connected to said carriage; and means on said carriage for infinite adjustment of the position of said second retention member along the carriage to the length of any tubular object within a given range of lengths.

29. Apparatus as claimed in claim 28, wherein:

said rod has a longitudinal groove communicating with said transverse slots for passage of said locking member among said slots.

30. Apparatus as claimed in claim 28 or 29 wherein:

said locking member is fixedly attached to said carriage.

31. Apparatus as claimed in claim 28, including:

a handle separate from said second retention member, said handle being connected to said carriage and extending radially relative to said rod.

32. Apparatus as claimed in claim 31, wherein:

said separate handle is fixedly attached to said carriage.

33. Apparatus as claimed in claim 31 or 32, wherein:

said handle encompasses said rod.

34. Apparatus as claimed in claim 33, wherein:

said locking member is fixedly attached to said handle.

35. Apparatus as claimed in claim 28, wherein:

said infinite adjustment means include an externally threaded portion on said carriage encompassing said rod and an internal thread at said second retention member meshing with said externally threaded portion.

36. Apparatus as claimed in claim 28, 29, 31, 33 or 35, including:

means for mounting said rod for rotation about an axis; and means for rotating said rod with carriage, first and second retention members and retained tubular object about said axis.

* * * * *